US006051263A

United States Patent [19]

Gorlich et al.

[11] Patent Number: 6,051,263

[45] Date of Patent: Apr. 18, 2000

[54] VENTABLE FOOD PACKAGE

[75] Inventors: Michael P. Gorlich; Robert F. McPherson, Jr., both of Hilton Head Island, S.C.; Robert C. James, Naples, Fla.

[73] Assignee: World Class Packaging Systems, Inc., Hilton Head Island, S.C.

[21] Appl. No.: 09/283,333

[22] Filed: Mar. 31, 1999

[51] Int. Cl.[7] ..... B65D 85/00

[52] U.S. Cl. ..... 426/129; 426/396; 426/392; 426/418; 53/432; 53/449; 220/359; 220/360; 220/361; 220/373

[58] Field of Search ..... 426/106, 118, 426/123, 125, 129, 392, 395, 396, 418, 419; 53/432, 449; 220/359, 360, 361, 373

[56] References Cited

U.S. PATENT DOCUMENTS

| | | | |
|---|---|---|---|
| 3,797,694 | 3/1974 | See et al. | 220/44 R |
| 3,997,677 | 12/1976 | Hirsch et al. | 426/113 |
| 4,548,824 | 10/1985 | Mitchell et al. | 426/111 |
| 5,587,192 | 12/1996 | Beizermann | 426/118 |
| 5,667,827 | 9/1997 | Breen et al. | 426/129 |
| 5,686,126 | 11/1997 | Noel et al. | 426/129 X |
| 5,686,127 | 11/1997 | Stockley, III et al. | 426/129 |
| 5,866,184 | 2/1999 | Gorlich et al. | 426/396 |

*Primary Examiner*—Milton Cano
*Attorney, Agent, or Firm*—Trop, Pruner & Hu, P.C.

[57] ABSTRACT

A package is capable of enclosing a food product in two different gaseous atmospheres at different times. Initially, the food product may be packaged in a low oxygen atmosphere in order to prolong the shelf life of the product. When it is time to sell the product for example, it may be desirable to supply oxygen to the food product. In the case of red meats, the oxygenation process causes the meat to turn a bright red color. The package includes a tray covered by a film with a plurality of apertures formed in the tray. The package may be maintained at a pressure below atmospheric pressure. The apertures are covered by a bacterial barrier layer covered by resealable tape which can be removed to allow air ingress and then resealed to protect the integrity of the tray contents.

17 Claims, 6 Drawing Sheets

VENTABLE FOOD PACKAGE

BACKGROUND OF THE INVENTION

This invention relates generally to methods and apparatus for packaging food products in two distinctly different atmospheric conditions.

For some time now, it has been appreciated that there are considerable advantages to be achieved from a package which can accommodate two distinctly different packaging concerns. The first of those concerns is to extend the shelf life of the product by reducing its exposure to oxygen. This means that the product is advantageously isolated from oxygen exposure from the time the food product is packaged until just before it is ready to go on sale. By avoiding oxygen exposure during this period, the shelf life of the package can be increased because exposure to oxygen is what begins the degradation of the food product. Thus, the product can be transported from a remote location to a point of sale over a number of days without endangering the product. The product's useful life is determined primarily from the time that oxygen exposure is initiated.

The second packaging concern relates to the situation where, particularly with respect to red meat, it is advantageous to expose the meat to oxygen prior to sale. The oxygen exposure causes the meat to turn bright red from its unexposed purple color. As mentioned above, oxygen exposure begins the degradation and thus, it is advantageous to forestall the oxygen exposure to the greatest possible extent.

A number of techniques have been proposed to allow the package to undergo two distinct states. One procedure involves a package which has a pair of films, one of which is permeable and the other of which is impermeable. When the impermeable film is removed, the permeable film remains. Oxygen flow from the atmosphere through the permeable film enables blooming of the food product, at least in the case of red meat.

Thus, there would be a considerable demand for a product which efficiently allows a package to experience two distinct packaging state with two distinctly different packaging environments.

SUMMARY OF THE INVENTION

In accordance with one aspect of the present invention, a food package includes a tray with a cavity surrounded by a peripheral flange. A film is secured to the flange over the tray. A plurality of passages through the tray are covered by a bacterial barrier layer and a removable tape cover that covers the layer. The passages may extend through the sidewall of the tray cavity or through the flange itself. The tape can be peeled to open the passages.

In accordance with another aspect, the package may be maintained at a pressure below atmospheric pressure. Thus, when the tape cover is removed, gas ingress is facilitated.

DESCRIPTION OF THE PREFERRED EMBODIMENTS

Figure 1:
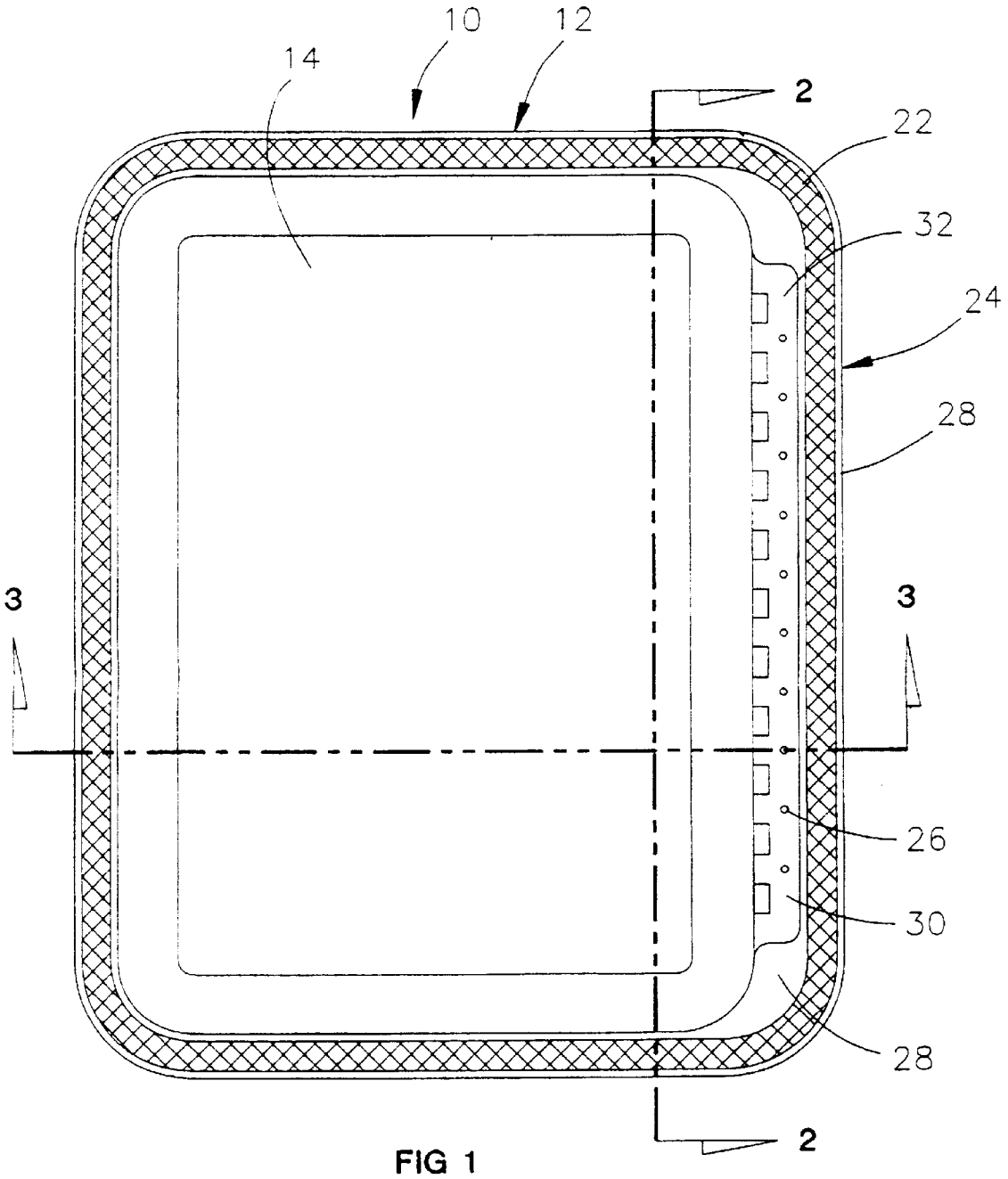
FIG. 1 is a top plan view of one embodiment.

Referring to the drawing wherein like reference characters are utilized for like parts throughout the several views, a food package 10 includes a molded plastic tray 12 covered by a plastic film 14. The plastic film 14 may be any of a variety of films utilized for covering food packages. As shown in FIG. 2, the tray 12 includes a lower surface 16, upwardly extending sidewall 18, and a peripheral flange 20 which extends substantially traversely away from the sidewall 18. The film 14 is secured by conventional techniques to the flange 20 as indicated at 22 in FIG. 1. For example, the film 14 may be heat sealed to the flange 20.

Figure 2:
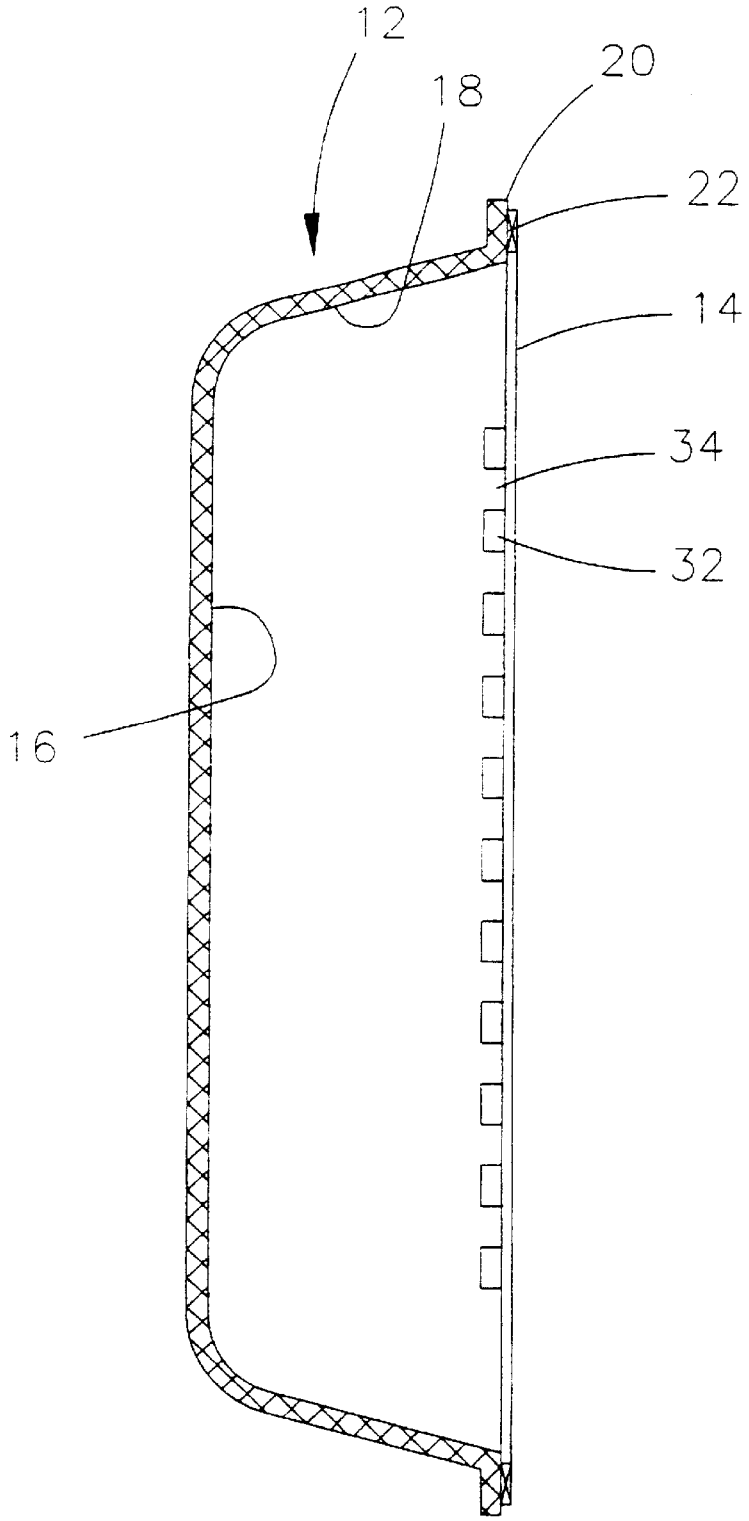
FIG. 2 is a cross-sectional view taken generally along the line 2—2 in FIG. 1.
Figure 3:
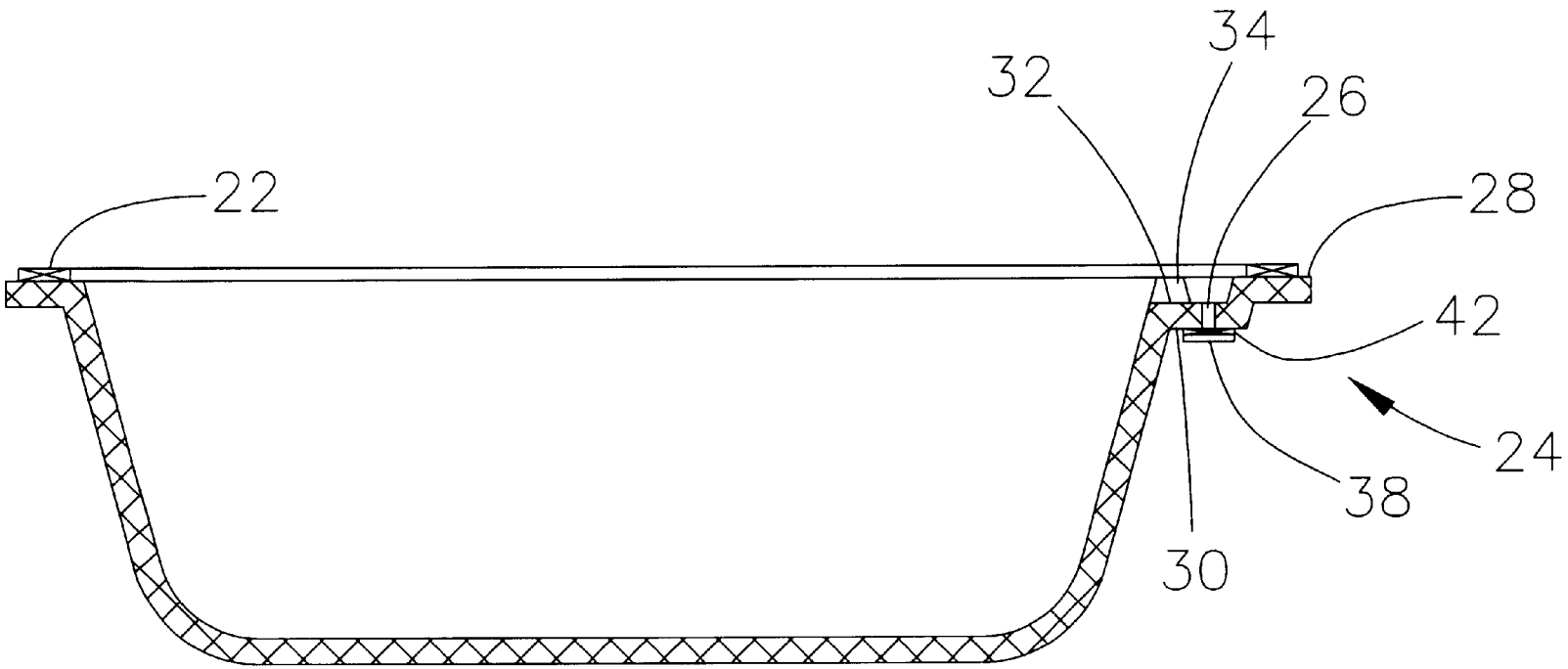
FIG. 3 is a cross-sectional view taken generally along the line 3—3 in FIG. 1.

As shown in FIGS. 1 and 3, one flange portion 24 may be of greater width than the remaining portions to accommodate a plurality of air passages 26, which selectively allow air ingress into the package interior. The flange portion 24 includes a film sealing area 28 and a passage area 30. The sealing area 28 is conventional in all respects and corresponds generally to the similar area on the remainder of the flange 20. The passage portion 30 includes a depression 32 which may be formed by appropriate molding techniques used for making the tray 12. The depression 32 is punctuated by a plurality of protrusions 34 which extend upwardly through the depression 32, situated to support the plastic film 14 in a substantially level configuration with the upper surface of the remainder of the flange 20.

The plurality of passages 26 extend through the passage portion 30 and exit on the lower surface of the flange portion 24. Each of the passages 26 may be substantially vertically oriented and together provide for the possibility of air ingress from the exterior, through the passage 26 via the depression 32 into the cavity formed by the lower surface 16 and upstanding sidewall 18 of the tray 12.

The exterior opening of the passage 26 may be covered by a piece of removable tape 38. The tape 38, in position, closes the passages 26, but when peeled away allows gas communications with the interior of the package 10 through a bacterial barrier layer 42. The layer 42 may be a manmade fibrous material such as spun-bonded polyester. One such fibrous material is Tyvek® sold by DuPont. The layer 42 may be permanently secured to the tray 12 while the tape 38 is removably secured to the layer 42.

Figure 4:
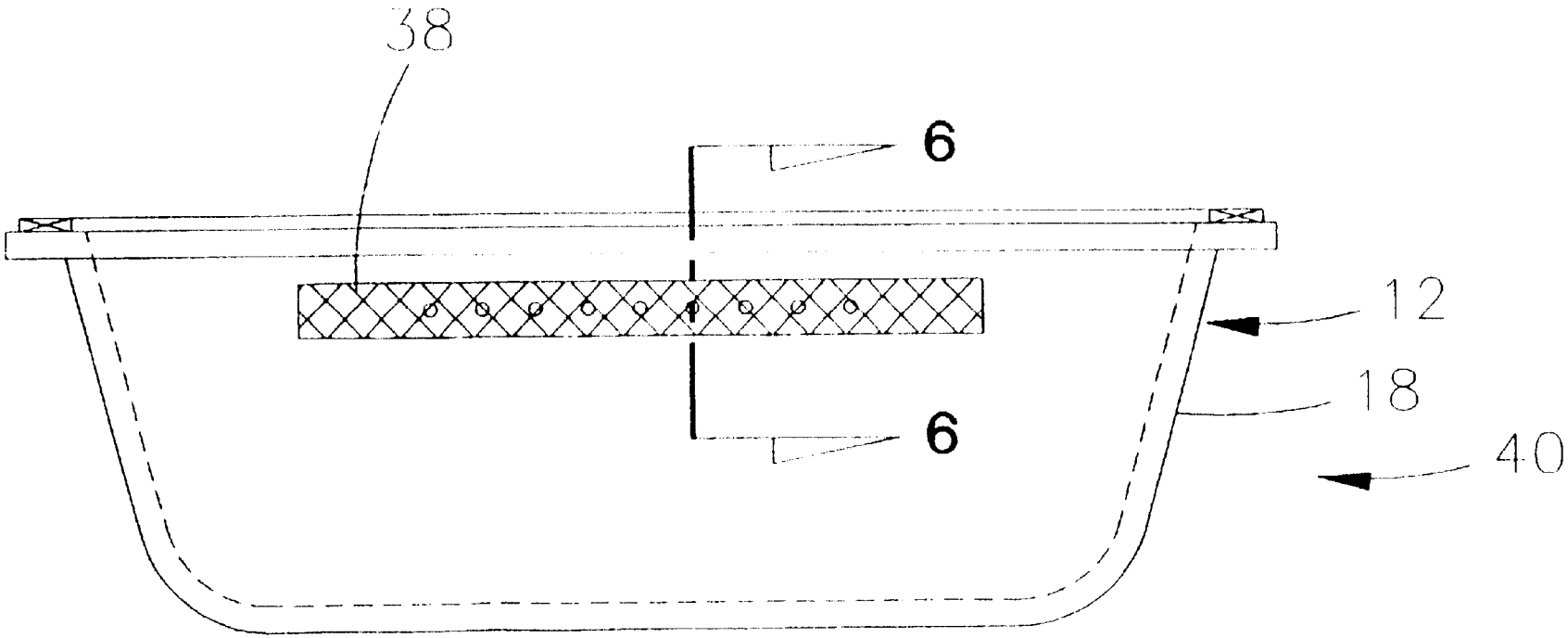
FIG. 4 is a side elevational view of another embodiment.
Figure 5:
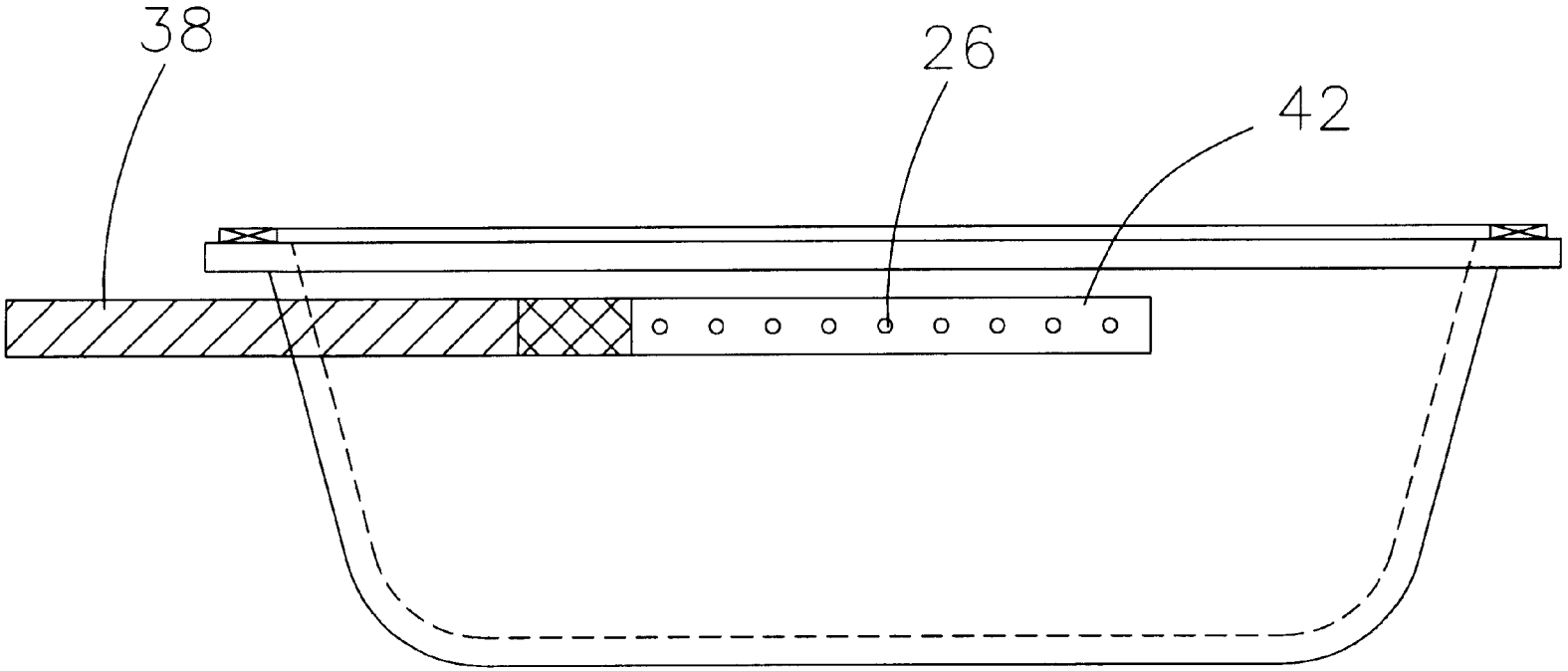
FIG. 5 is a side elevational view of the embodiment shown in FIG. 4 with the cover partially removed.
Figure 6:
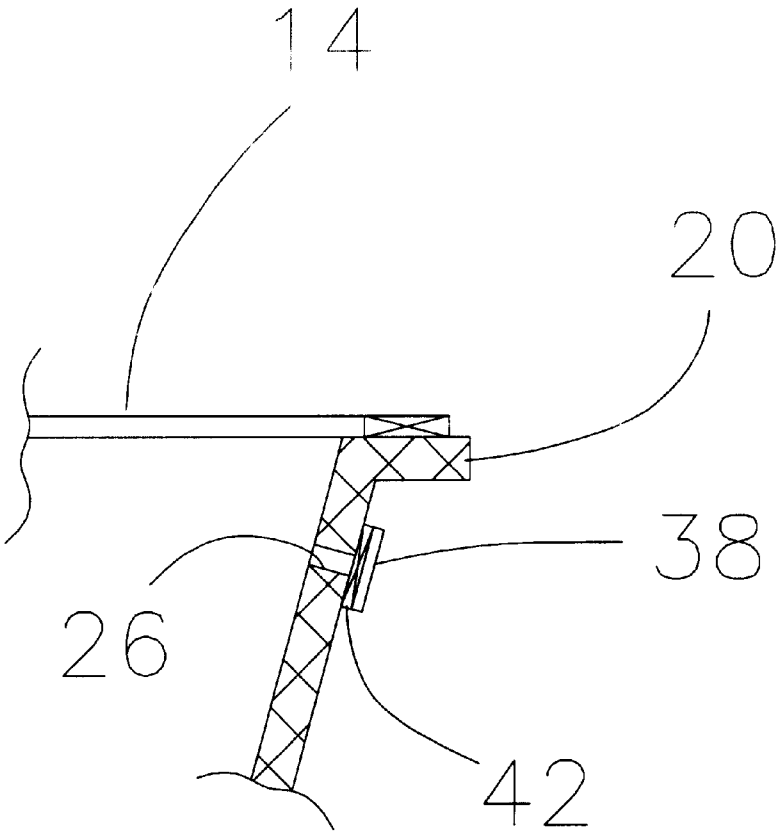
FIG. 6 is an enlarged cross-sectional view taken generally along the line 6—6 in FIG. 4.

Another embodiment, shown in FIGS. 4 through 6, includes a package 40 with a tray 12 having an upstanding sidewall 18 and a lower surface 16, together with a peripheral flange 20. The film 14 may be secured by heat sealing the film onto the peripheral flange 20. As in the previous embodiment, a film 14 is secured by heat sealing the film onto the peripheral flange 20.

A plurality of passages 26 are formed through the upstanding sidewall 18 of the tray 12 proximate to the flange 20. On the exterior of the package, the apertures 26 are covered by a tape 38, which may be peeled away to open the outside entrance to the passages 26 via the bacterial barrier layer 42.

As shown in FIG. 6, each passage 26 is covered by the bacterial barrier layer 42 which is secured to the exterior surface of the upstanding sidewall 18 over the passages 26. By making the tape 38 substantially impermeable to gas, the tape 38 prevents gas flow into or out of the package. When the tape is removed as indicated in FIG. 4, the layer 42 is useful in preventing liquid outflow and bacterial infusion to the food product contained in the package.

In use, a food product such as a piece of meat may be enclosed inside the tray 12 by sealing a film 14 to the flange

20. Because it is done in a low oxygen atmosphere, the shelf life of the meat product may be substantially extended. However, because of the consumer's desire to purchase meat which is of a red bloomed color, it is necessary to expose the meat to oxygen proximate to the time of sale. In the embodiment shown in FIGS. 1 through 3, this would be done by removing the tape 38 allowing air ingress through the passages 26 and into the tray 12 via the depression 32. The integrity of the air flow passageway is insured by the presence of the protrusions 34.

Similarly, in the embodiment shown in FIGS. 4 through 6, air exchange is provided by removing the exterior tape 38 covering the upstanding sidewall 18 and particularly the passages 26. Once removed, air exchange is possible.

In each case it may be desirable to replace the tape covering 38 after blooming has been achieved. If the tape 38 is resealable, this can be easily accomplished with the same piece of tape that was previously removed. That is, after the meat has bloomed, the tape covering 38 can be replaced.

It is also advantageous to create a negative gas pressure inside the package. A negative gas pressure is one which is less than atmospheric pressure. Then, when the tape 38 is removed, air rushes in to change the atmosphere of the package more readily.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A food package comprising:

a tray having a cavity surrounded by a peripheral flange, said tray cavity containing a food product therein;

a film secured to said flange over said tray;

a plurality of passages through said tray;

a bacterial barrier layer covering said passages; and a removable cover covering said layer.

2. The package of claim 1 wherein said removable cover is a piece of removable tape.

3. The package of claim 1 wherein said layer is fixed to said tray.

4. The package of claim 2 wherein said layer is formed of spun bonded polyester.

5. The package of claim 2 wherein said passages extend through said flange.

6. The package of claim 1 wherein said tray includes a lower surface and an upstanding sidewall connected to said flange, said passages extending through said sidewall.

7. The package of claim 1 wherein said flange includes a first portion which sealingly connects to said film and a second portion inboard of said portion, which includes a depression which allows gas to be communicated through said passage via said depression into said tray.

8. The package of claim 7 wherein said depression includes a plurality of spaced protrusions which extend upwardly through the depression and serve to support said film over said depression.

9. The package of claim 1 wherein the gas pressure inside said package is lower than atmospheric pressure.

10. A tray holding food products comprising:

a cavity having a lower surface and an upstanding peripheral wall connected thereto;

a flange connected to said upstanding peripheral wall adapted to sealingly engage a film cover;

a plurality of passages extending through said tray to allow selective communication with the exterior of said tray;

a bacterial barrier layer secured over said passages; and a removable tape removably secured over said barrier layer.

11. The tray of claim 10 wherein said barrier layer is on the outside of said tray.

12. The tray of claim 11 wherein said barrier layer is a fibrous material.

13. The tray of claim 12 wherein said material is spun-bonded polyester.

14. The tray of claim 10 wherein said tape is resealable.

15. The tray of claim 10 wherein said passages extend through said flange.

16. The tray of claim 15 wherein said flange includes an outer peripheral sealing region and at least a portion of said flange includes a region for providing airflow passage from the interior of said package to the exterior, said portion including a plurality of upstanding protrusions which extend from the flange upwardly to support the film cover.

17. The tray of claim 10 including a plurality of apertures through said upstanding peripheral wall.

* * * * *